United States Patent [19]

Michelman et al.

[11] 4,120,182

[45] * Oct. 17, 1978

[54] TAMPER-PROOF LOCKING DEVICE

[75] Inventors: Lionel S. Michelman, Pomona; Samuel M. Michelman; David L. Michelman, both of Queens; Milton Michelman, Long Beach, all of N.Y.

[73] Assignee: Michelman Iron Works Corp., Brooklyn, N.Y.

[ * ] Notice: The portion of the term of this patent subsequent to Jun. 28, 1994, has been disclaimed.

[21] Appl. No.: 861,687

[22] Filed: Dec. 19, 1977

Related U.S. Application Data

[63] Continuation-in-part of Ser. No. 783,274, Mar. 31, 1977, Pat. No. 4,096,718, which is a continuation-in-part of Ser. No. 693,293, Jun. 7, 1976, Pat. No. 4,031,722.

[51] Int. Cl.[2] ..... E05B 65/52

[52] U.S. Cl. ..... 70/63; 70/34; 70/158; 70/417

[58] Field of Search ..... 70/63, 32–34, 70/77–78, 158–159, 417; 24/211 R, 211 N

[56] References Cited

U.S. PATENT DOCUMENTS 3,968,985 7/1976 Nielsen ..... 292/340

4,031,722 6/1977 Michelman ..... 70/63

*Primary Examiner*—Robert L. Wolfe

*Attorney, Agent, or Firm*—Kirschstein, Kirschstein, Ottinger & Cobrin

[57] ABSTRACT

A tamper-proof locking device mountable on a lidded container or the like. A first member has a first portion which overlies the closed lid of the container. A second portion of the first member overlies a side wall of the container below the lid. A third portion of the first member extends away from the second portion and the container side wall. An opening in the third portion has an axis which is perpendicular to the plane of the lid. The second portion is secured to the side wall of the container. The second member has a first portion which cooperates with the first member when assembled thereon to form an enclosure that prevents access of a tool to the element which secures the second portion of the first member to the container side wall. The second member has a second portion which is parallel to the third portion of the first member and which has an opening. This opening is in alignment with the opening in the third section of the first member. A rectilinear shackle is receivable in the openings. The shackle includes a projection which extends and underlies the third portion of the first member.

28 Claims, 10 Drawing Figures

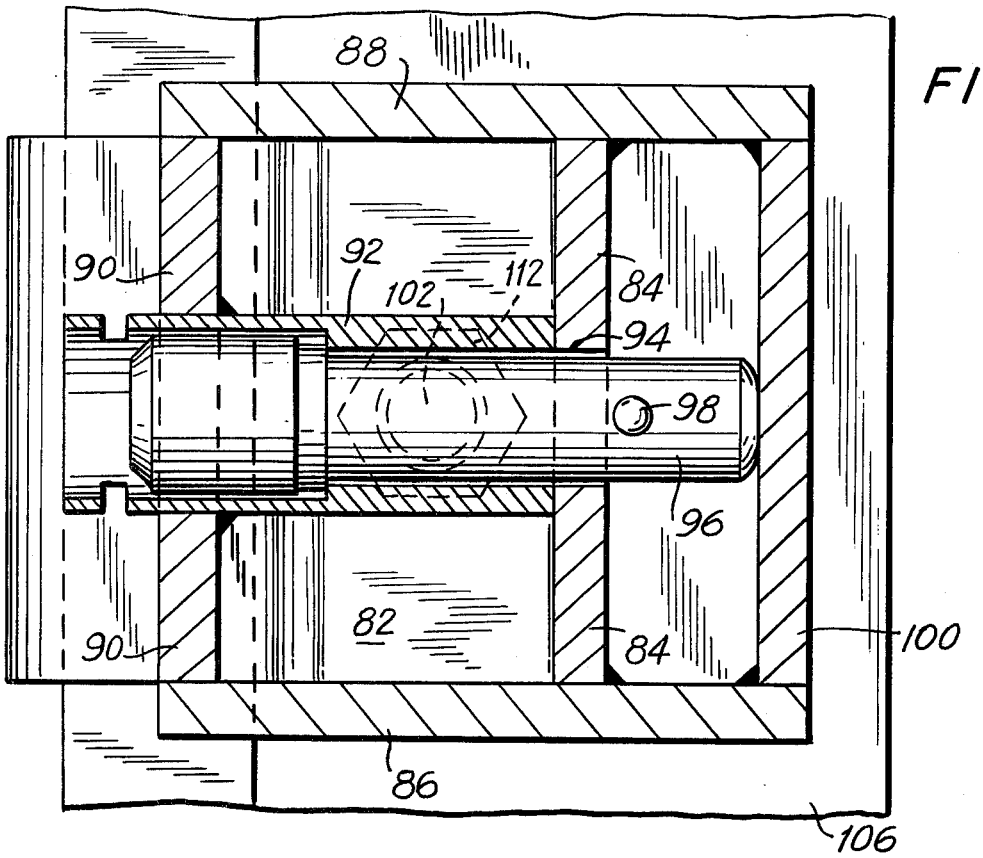
FIG. 8
FIG. 9
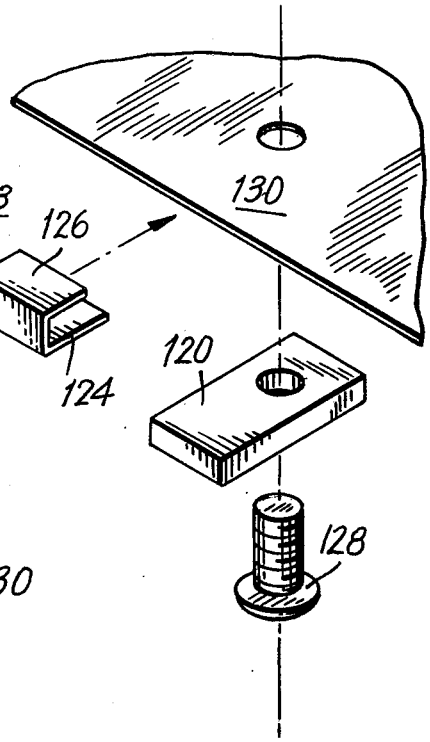
FIG. 10
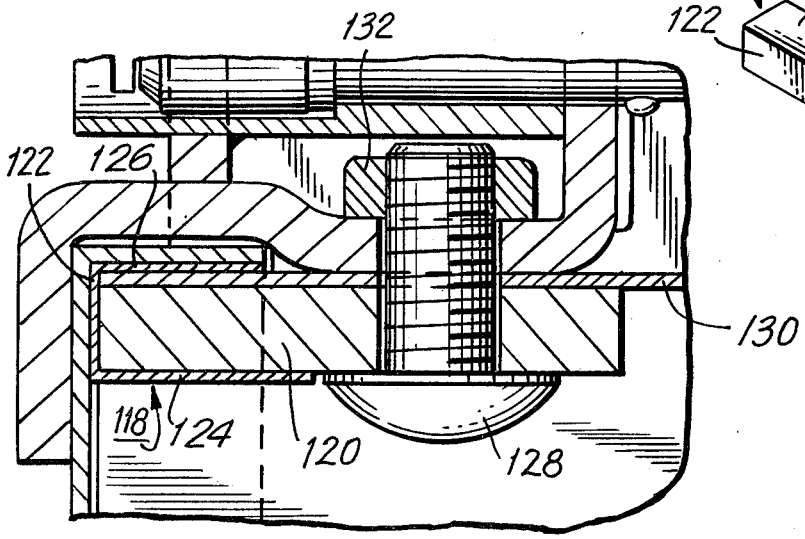

TAMPER-PROOF LOCKING DEVICE

CROSS-REFERENCE TO RELATED APPLICATIONS

The present application is a continuation-in-part of U.S. Patent application Ser. No. 783,274 filed Mar. 31, 1977 and now U.S. Pat. No. 4,096,718 which is a continuation-in-part of U.S. Patent application Ser. No. 693,293 filed June 7, 1976 now U.S. Pat. No. 4,031,722 issued June 28, 1977.

BACKGROUND OF THE INVENTION

1. Field of the Invention

The invention relates to a tamper-proof locking device for lidded containers, to be used in conjunction with a lock having a rectilinear shackle, such as a barrel lock.

2. Description of the Prior Art

The necessity for locking containers is widely understood. Perhaps the most ubiquitous locking means and device of the prior art is a simple hinged hasp, i.e. a fastener for a door or lid consisting of a hinged metal strap provided with a slot, which fits over a staple and is secured by a pin or padlock. Such simple devices are objectionable for usage where inspection of the container is not frequent, e.g. in the case of meter wiring cabinets which contain the service wires that are connected to an electric meter, since a simple hasp is not tamper-proof. A major problem of electric utility companies, especially in urban areas, is that the wiring cabinets are broken open and the wires are tampered with to shunt the meter so that the customer can receive electricity without it being recorded. there are literally thousands of these boxes and cabinets in the average electric utility system which do not have any provision for a lock, or which are readily opened because, as presently constituted, they merely have a hasp or the like and are not tamper-proof.

Pertinent prior art in this field includes U.S. Pat. Nos. 4,049,313; 3,968,985; 3,938,939 and 3,727,438; and German Pat. No. 1,292,033.

SUMMARY OF THE INVENTION

1. Purpose of the Invention

It is an object of the present invention to provide a tamper-proof locking device.

Another object is to provide an improved locking device for the locking of cabinets, boxes, or any container provided with a lid.

A further object is to provide a locking device for the lid of a container which does not have any in situ provision for a lock.

An additional object is to provide a locking device which can be used on many different varieties and sizes of lidded boxes or containers of any type.

Still another object is to provide a locking device which is readily and simply installed.

Still a further object is to deter crime by providing a locking device which makes lidded containers tamper-proof.

Another object is to provide a universal locking device for the locking of a cover or lid on a vessel or container.

Another object is to provide a locking device for a lidded box or the like, which is installed in place without being permanently attached to the box.

These and other objects and advantages of the present invention will become evident from the description which follows.

2. Brief Description of the Invention

In the present invention, in one emboidment the tamperproof locking device includes a first member and a second member. The first member is a generally zig-zag strip which is divided into a first, second and third portion in series at right angles to each other. The second portion of the first member is secured to the wall of a container adjacent the interface between the container wall and the lid or cover of the container, so that the first portion of the first member overlies the lid or cover of the closed container when the first member is emplaced. The third portion of the first member has an opening.

The second member is generally U-shaped and mountable on the first member, with the legs of the second member laterally surrounding the third portion of the first member. The second member includes a sleeve portion which is coaxially aligned with the opening in the third portion of the first member, so that a lock having a rectilinear shackle and terminal means for lateral extension is receivable in the sleeve portion of the second member and in the opening in the third portion of the first member, with the terminal means being laterally extended below the opening. Finally, first and second baffles are provided, each baffle covering one end of the second member against ingress of a tool.

In one preferred emboidment of the invention, the opening in the third portion of the first member is circular, and a retention sleeve having a cylindrical inner passage depends from the third portion of the first member, so that the circular opening in the third portion of the first member is coaxial with the cylindrical inner passage of the retention sleeve. The retention sleeve has a circular inner slot or recess which extends outwards from the cylindrical inner passage. The first baffle mentioned supra, in this embodiment, depends from the retention sleeve and is parrallel to the third portion of the first member. The legs of the second member surround the retention sleeve as well as the third portion of the first member, and one end of the second member abuts the periphery of the first baffle. In this embodiment, the second baffle extends transversely from the base of the second member, at the other end of the second member, so that an end portion of the second baffle overlies the first portion of the first member. The other portion of the second baffle, i.e. that portion between the legs of the second member, has a circular opening. A cylindrical guide sleeve extends between and parallel to the legs of the second member from the circular opening in the second baffle. The guide sleeve is coaxially aligned with the circular opening in the third portion of the first member as well as with the retention sleeve, so that a cylindrical lock having a rectilinear shackle and terminal means for lateral extension is receivable in the guide sleeve, in the circular opening in the third portion of the first member, and in the cylindrical inner passage in the retention sleeve, with the terminal means for lateral extension being laterally extended into the circular inner slot or recess in the retention sleeve.

The lock employed in the present locking device is typically a barrel lock. In a preferred embodiment, the retention sleeve is cylindrical in which case the cylindrical inner passage in the retention sleeve is centrally oriented coaxially with the retention sleeve itself. In many instances the second portion of the first member will be stepped into two non-coplanar sections. A first section will be contiguous with a terminal lip of the lid or cover of the container, which terminal lip overlies the wall of the container. A second section will be juxtaposed with the wall of the container, with the means for securing the second portion of the first member to the wall of the container extending through this second section of the second portion of the first member. Typically, the means for securing the second portion of the first member to the wall of the container is a threaded bolt and a nut, in conjunction with a plate. The bolt extends through coaxial openings in the plate, the wall of the container, and the second portion of the first member. The plate is disposed inside the container; preferably, the plate extends to the edge of the container wall so that the end of the plate is contiguous with the lid or cover of the container. Usually the plate is rectangular, with one edge of the plate being parallel to and juxtaposed with the lid or cover of the container. Preferably, the guide sleeve extends outwards beyond the opening in the second baffle, and the outward extension of the guide sleeve is provided with at least two openings so that a seal may be inserted to cover the lock. In a preferred emboidment, the terminal edge of each of the legs of the second member is stepped into two non-coaxial sections. One section is contiguous with a terminal lip of the lid or cover of the container, and the other section is juxtaposed with the wall of the container. Finally, this embodiment of the invention, the third portion of the first member is preferably provided with a terminal tab and the base of the second member is provided with a slot, with the tab extending into the slot.

In another embodiment of the invention, the first member and the second member described supra are parts of a unitary bracket. The base of a portion of the second member is parallel to at least part of the second portion of the first member, so that an enclosure is formed by the second and third portions of the first member and the aforementioned portion of the second member. One baffle extends transversely from the base of the second member at the (upper) end of the second member spaced away from the third portion of the first member. This baffle terminates at the second portion of the first member, and this baffle has a circular opening from which a cylindrical guide sleeve depends into the enclosure. The guide sleeve is coaxially aligned with the circular opening in the third portion of the first member, so that the cylindrical barrel lock having a rectilinear shackle and terminal means for lateral extension is receivable in the guide sleeve and in the circular opening in the third portion of the first member, with the terminal means being laterally extended between the third portion of the first member and a (lower) baffle means at the end of the second member.

In this embodiment of the invention, the threaded bolt and plate are preferably mounted to the wall of the container by means of a clip, prior to fastening the first member as described supra by means of a nut screwed onto the threaded bolt. The reason for the provision of the mounting clip is so that the bolt may be held in place as the unitary bracket is inserted over the bolt, i.e. manual holding or manipulation of the bolt at this time is precluded due to the configuration of the bracket which surrounds the bolt; without the presence of the clip, in some instances the bolt would be pushed into the container by the bracket, i.e. by the second portion of the first member. In general, a first portion of the clip is attached to one (the upper) edge of the plate, and a second portion of the clip depends perpendicularly from an edge of the first portion of the clip. The second portion of the clip is parallel to and spaced from the plate, so that the plate is receivable on the edge of the container wall by disposing the container wall between the plate and the second portion of the clip. In one preferred embodiment, the first portion of the clip is provided with a coplanar extension which underlies the lid or cover of the container. In another preferred embodiment, the first portion of the clip is provided with a substantially perpendicular extension which is parallel to the second portion of the clip and contiguously disposed on the opposite side of the plate.

The locking device of the present invention presents several salient advantages. The device essentially is tamperproof, and thus the considerations developed above with regard to electric meter wiring cabinets or the like present an exemplary utility for the device. The device readily is installed in place without being permanently attached to the container or box or the like. The device is a universal locking device applicable to the locking of a cover or lid on a vessel or container or the like, or for the locking of virtually any enclosure elements which meet at substantially a right angle. The device deters crime with a locking device which makes lidded containers or the like essentially tamper-proof. The device is readily and simply installed, and may be used on many different varieties and sizes of lidded boxes, cabinets, or containers or the like, of any type. The term "lid" in this regard will be understood to encompass and include various types of door, e.g. a door on a bathroom medical cabinet, in which instance the device could prevent children from swallowing deleterious, dangerous or poisonous medicines and the like often found in home medical cabinets. An important advantage is that the device is applicable where there is no in situ provision for a lock.

The invention accordingly consists in the features of construction, combination of elements and arrangement of parts which will be exemplified in the device hereinafter described and of which the scope of application will be indicated in the appended claims.

BRIEF DESCRIPTION OF THE DRAWINGS

In the accompanying drawings in which are shown various possible embodiments of the invention:

FIG. 8 is a sectional plan view taken substantially along the line 8—8 of FIG. 6;

FIG. 9 is an exploded view showing the mode of emplacement of an alternative version of the clip; and FIG. 10 is a partial sectional elevation view similar to FIG. 6 and showing the alternative version of the clip in place.

DETAILED DESCRIPTION OF THE PREFERRED EMBODIMENTS

Figure 1:
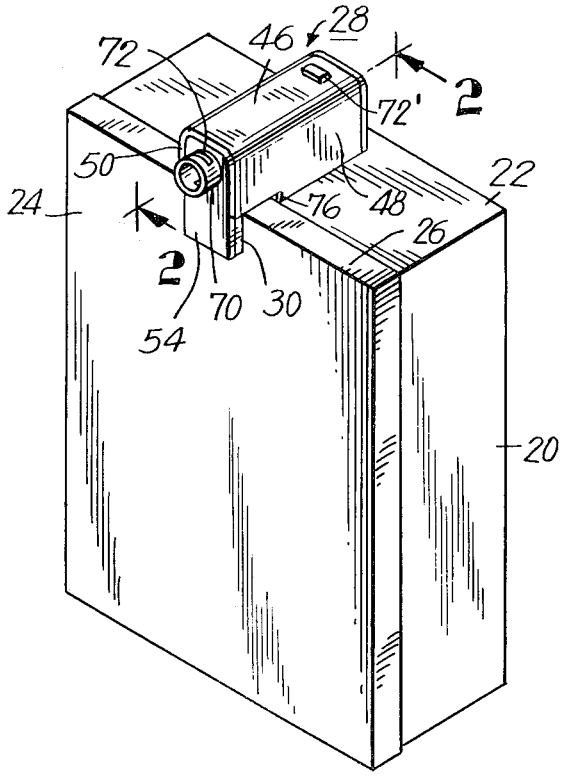
FIG. 1 is a perspective view of one embodiment of the invention.
Figure 2:
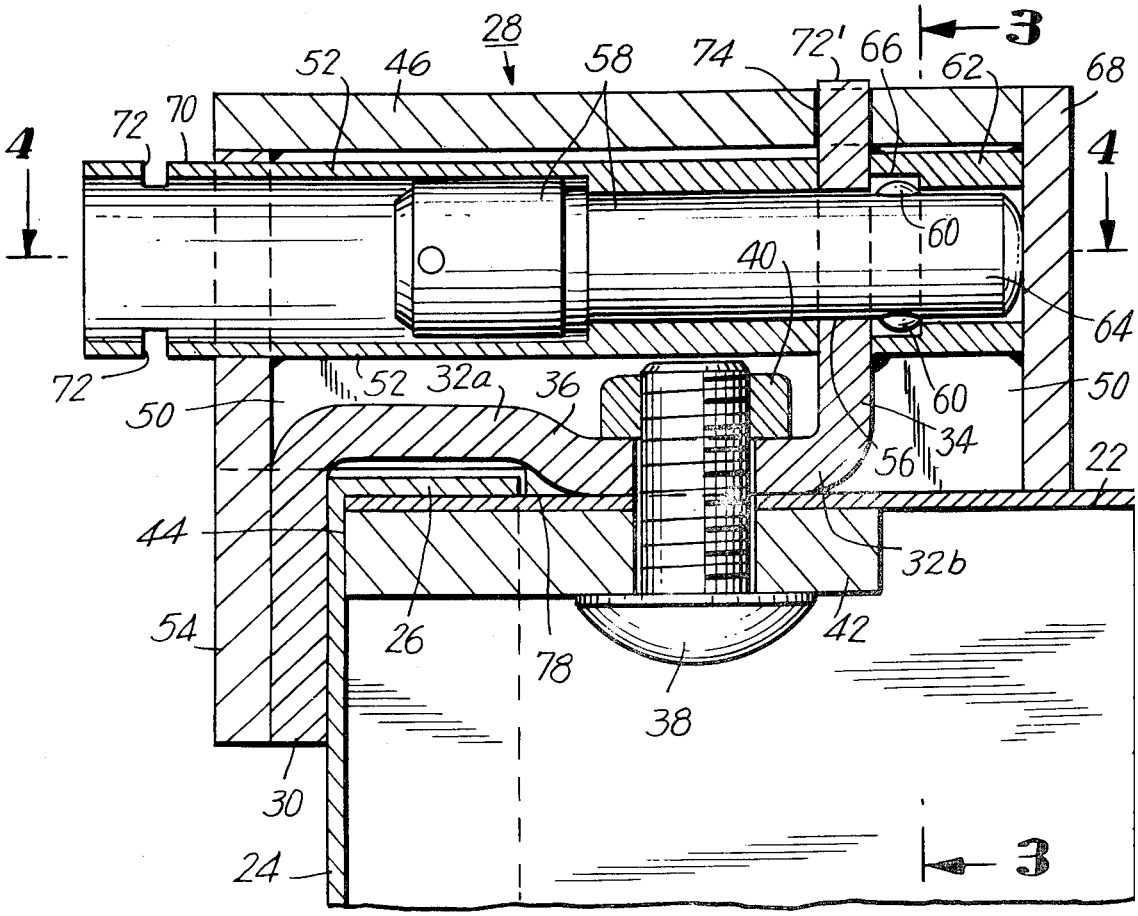
FIG. 2 is a sectional elevation view taken substantially along the line 2—2 of FIG. 1.
Figure 3:
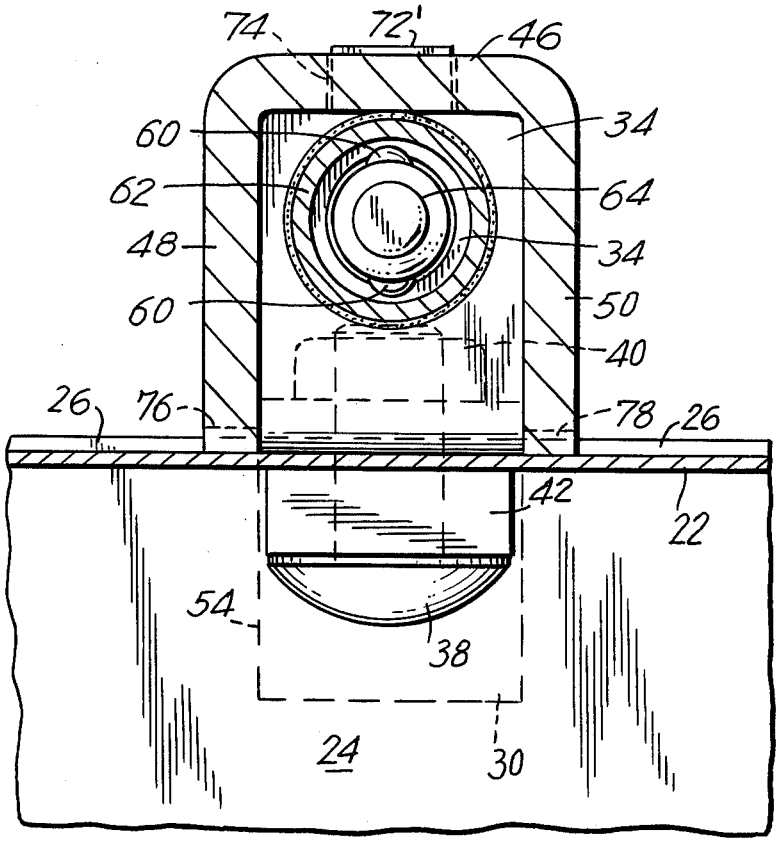
FIG. 3 is a sectional elevation view taken substantially along the 3—3 of FIG. 2.

Referring now to FIGS. 1, 2, 3 and 4, a container 20 is provided with a front or top wall 22 and a lid or cover 24. The lid has a terminal peripheral lip 26 which depends over a portion of the wall 22. As shown, the lid 24 is in place over the container 20 so as to close the container 20. A locking device 28 in accordance with the present invention is in place at the interface between the lid 24 and the container wall 22; the device 28 extends over a portion of the lip 26. The tamper-proof locking device 28 includes a first member having three portions 30, 32 and 34 at generally right angles to each other, in the form of a generally zig-zag strip. The second portion 32 is divided into two non-coplanar sections 32*a* and 32*b* which are joined by a step 36 to accommodate for the lip 26. Section 32a is contiguous with the terminal lip 26 while section 32*b* is juxtaposed with the wall 22 of the container 20. Section 32*b* is secured to the wall 22 by means of a threaded bolt 38 and a nut 40; a plate 42 is interposed between the head of bolt 38 and the wall 22. The edge 44 of plate 42 is contiguous with the lid 24. As best shown in FIG. 2, the threaded shank of bolt 38 extends through openings in the plate 42, the wall 22 and section 32*b* to the nut 40.

Figure 4:
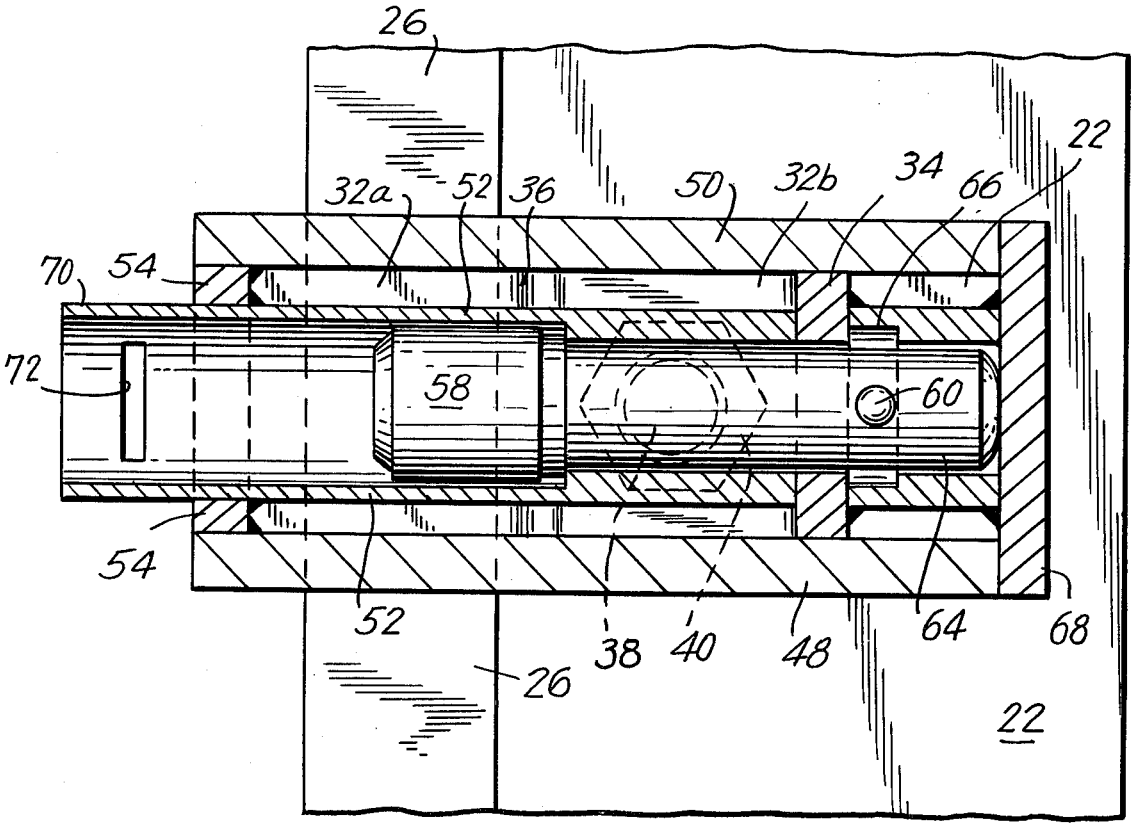
FIG. 4 is a sectional plan view taken substantially along the line 4—4 of FIG. 2.
Figure 5:
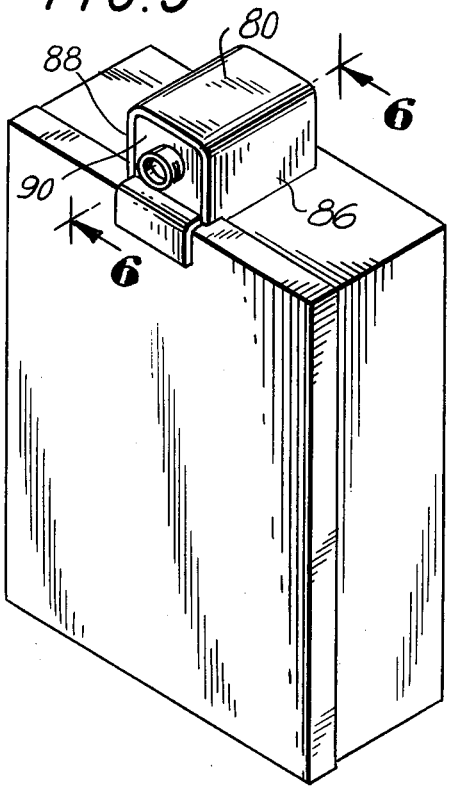
FIG. 5 is a perspective view of an alternative embodiment of the invention.

The second member is of generally U-shaped configuration, being provided with a base 46 and two legs 48 and 50. The second member, as shown, is mountable on the first member with the legs 48 and 50 laterally surrounding, i.e. straddling, the third portion 34 of the first member, as best seen in FIG. 4. The second member includes a guide sleeve portion 52 which depends from an opening in an upper baffle 54; the baffle 54 extends from the base 46 and overlies the first portion 30. The sleeve portion 52 is externally welded about its perimeter to the baffle 54 as shown, and the baffle 54 is in turn welded to the base 46 and the legs 48 and 50 as shown.

The sleeve 52 extends to a terminus in juxtaposition with the third portion 34, which is provided with a circular opening 56 which is coaxial with the sleeve 52, so that a barrel lock 58 having a rectilinear shackle and lower projections 60, which constitute terminal means for lateral extension, may be inserted into the sleeve portion 52 and through the opening 56. A retention sleeve 62 depends from the portion 34. The retention sleeve 62 has a cylindrical inner passage to accommodate the terminal end 64 of the lock 58, and a circular inner slot or recess 66 which extends outwards from the inner cylindrical passage in sleeve 62 to accommodate lateral extension of projections 60 below the opening 56 in portion 34. The outer perimeter of sleeve 62 is welded to the portion 34 as shown. In addition, the outer perimeter of the other (lower) end of sleeve 62 is welded to a closure baffle 68 which extends across the end of the second member to prevent the ingress of a tool. The presence of the other (upper) baffle 54 also prevents the ingress of a tool.

The guide sleeve 52 has an outer (upper) portion 70 which is provided with opposed slots 72, so that a seal, not shown, may be inserted to cover the lock 52. The third portion 34 of the first member is provided with a terminal tab 72' which extends into a slot 74 in the base 46 of the second member. This structural feature provides greater structural integrity and precludes twisting or partial rotation of the second member. Finally, the terminal edge of leg 48 is stepped via a step 76 into two non-coaxial sections, and the terminal edge of the other leg 50 is also stepped via a step 78 into two non-coaxial sections. One section in each instance is contiguous with the terminal lip 26 while the other section in each case is juxtaposed with the wall 22 of the container 20.

Figure 7:
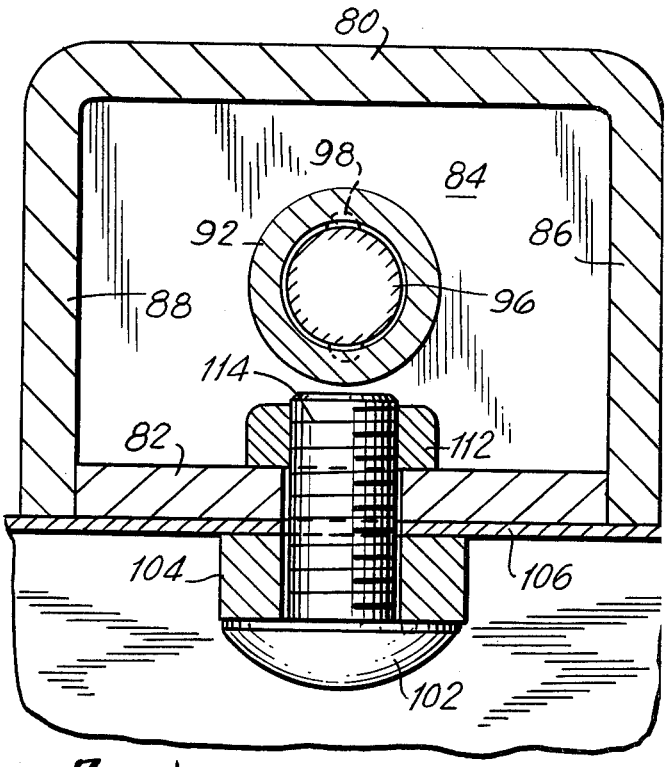
FIG. 7 is a sectional elevation view taken substantially along the line 7—7 of FIG. 6.
Figure 6:
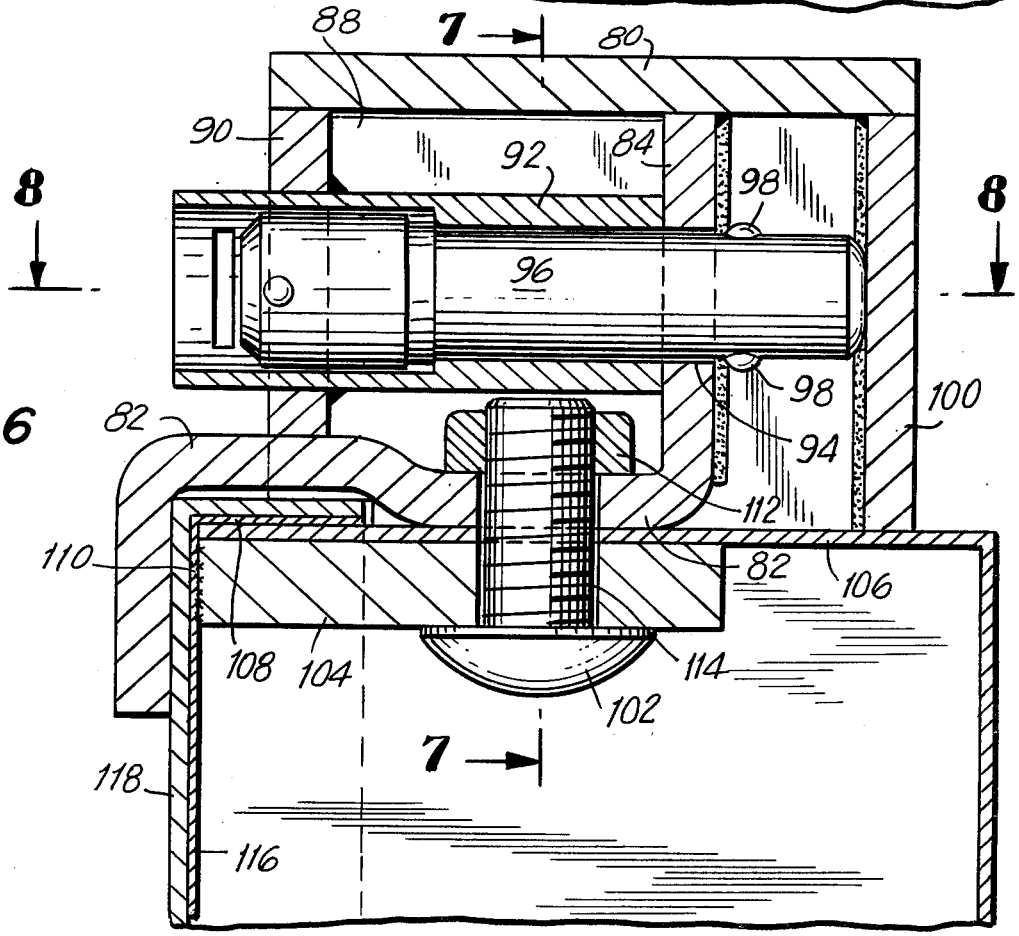
FIG. 6 is a sectional elevation view taken substantially along the line 6—6 of FIG. 5.

Referring now to FIGS. 5, 6, 7 and 8, an alternative embodiment of the invention is shown, entailing the provision of a unitary bracket which encompasses both the first member and the second member in combination. A portion of the base 80 of the second member is parallel to at least part of the second portion 82 of the first member, so that an enclosure is formed by the second portion 82 and the third portion 84 of the first member, the base 80 of the second member, and the legs 86 and 88 of the second member, since the first and second members are welded together at appropriate interfaces. The enclosure aspect is best seen in FIG. 7. A baffle 90 extends transversely from the base 80 of the second member at the upper end of the second member which is spaced away from the third portion 84 of the first member. This baffle 90 terminates at the second portion 82 of the first member. The baffle 90 has a circular opening from which a cylindrical guide sleeve 92 depends into the enclosure. The guide sleeve 92 is coaxially aligned with a circular opening 94 in the third portion 84 of the first member, so that a cylindrical barrel lock 96 having a rectilinear shackle and terminal projections 98 or other means for lateral extension is receivable in the guide sleeve 92 and the circular opening 94, with the terminal means 98 being laterally extended between the third portion 84 of the first member and a lower baffle 100 at the end of the second member. As shown in FIGS. 6 and 8, the periphery of baffle 100 is welded to the inner walls of the second member.

In this embodiment of the invention, the threaded bolt 102 and plate 104 are preferably mounted to the wall 106 of the container by means of a clip having a first portion 108 and a second portion 110. This is done prior to fastening the first member by means of nut 112 which is screwed onto the shank 114 of the threaded bolt 102. As discussed supra, the clip consisting of portions 108 and 110 is provided as a mounting clip so that the bolt 102 is held in place as the unitary bracket is inserted over the bolt, prior to screwing the nut 112 onto the shank 114. The clip portion 110 is attached to the upper edge of the plate 104 by welding, as best seen in FIG. 6, and the other clip portion 108 depends perpendicularly from an edge of portion 110 as shown. The other clip portion 108 is parallel to and spaced from the plate 104, so that the plate 104 is receivable on the inner side and edge of the container wall 106 by disposing the container wall 106 between the plate 104 and the clip portion 108, as best seen in FIG. 6. As best seen in this FIG. 6, the portion 110 of the clip is provided with a coplanar extension 116 which underlies the lid or cover 118 of the container. In another embodiment as shown in FIGS. 9 and 10, the clip 118 is not permanently fastened to the plate 120 but instead the portion 122 of the clip 118 is provided with a substantially perpendicular extension 124 which is parallel to the other portion 126 of the clip and contiguously disposed on the opposite side of plate 120, so that the resilient clip 118 holds the plate 120 and threaded bolt 128 in place on the side wall 130 of the container prior to emplacement of the unitary bracket and nut 132. This mode of assembly is best seen in FIG. 9.

It thus will be seen that there is provided a tamper-proof locking device which achieves the various objects of the invention and which is well adapted to meet the conditions of practical use.

As various possible embodiment might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A tamper-proof locking device mountable on a lidded container or the like, said device comprising a first member and a second member, said first member having a first portion constructed and arranged to overlie the lid of the container when the lid is closed, said first member having a second portion functionally unitary with and rigidly secured to said first portion, said second portion being constructed and arranged to overlie a side wall of the container below the lid, said first member having a third portion functionally unitary with and rigidly secured to the second portion and extending away from said second portion in a direction away from said side wall of the container, said third portion having an opening therein the axis of which is perpendicular to the plane of the lid, means to firmly secure said second portion to said side wall of the container, said securing means including at least one element constructed and arranged to be operated by a tool in cooperation therewith and located externally of the container, said element in securing position being disposed on the surface of the second portion remote from the container, said second member including a first portion which in cooperation with said first member and when assembled thereon defines with said first member an enclosure that prevents access of a tool to said element, said element in the absence of said second member being accessible to said tool and when said second member is assembled on said first member being inaccessible to said tool, said second member having a second portion which is substantially parallel to the third portion of said first member, said second portion of said second member having an opening therein in alighment with the opening in the third portion of the first member, and a rectilinear shackle receivable in said openings, said shackle having a head constructed and arranged to be disposed above the opening in said second member, said shackle additionally including at a point remote from said head a projection which is extensible from and receivable in said shackle, said projection when the second member is assembled on the first member being arranged to be extended to underlie the third portion of the first member.

2. A device is set forth in claim 1 wherein the securing means includes two sections, one section being disposed within the container and the other section extending through the second portion of the first member, and means to temporarily secure the first section to the inside of the container prior to mounting the first portion on the closed container.

3. A tamper-proof locking device mountable on a lidded container or the like comprising a first member and a second member, said first member being a generally zig-zag strip which is divided into a first, a second and a third portion in series at substantially right angles to each other, means for securing the second portion of said first member to the wall of a container or the like adjacent the interface between the container wall and the lid or cover of the container, so that said first portion of said first member overlies the lid or cover of the closed container when said first member is emplaced, said third portion of said first member having an opening, said second member being generally U-shaped and mountable on said first member with the legs of said second member laterally surrounding the third portion of said first member, said second member including a sleeve portion coaxially aligned with the opening in said third porton of said first member so that a lock having a rectilinear shackle and terminal means for lateral extension is receivable in said sleeve portion and said opening in said third portion of said first member, with said terminal means being laterally extended below said opening, and first and second baffle means, each baffle means covering one end of said second member against ingress of a tool.

4. A tamper-proof locking device mountable on a lidded container or the like comprising a first member and a second member, said first member being a generally zig-zag strip which is divided into a first, a second and a third portion in series at substantially right angles to each other, means for securing the second portion of said first member to the wall of a container or the like adjacent the interface between the container wall and the lid or cover of the container, so that said first portion of said first member overlies the lid or cover of the closed container when said first member is emplaced, said third portion of said first member having a circular opening, a retention sleeve having a cylindrical inner passage, said retention sleeve depending from said third portion of said first member so that the circular opening in said third portion of said first member is coaxial with the cylindrical inner passage of said retention sleeve, said retention sleeve having a circular inner slot or recess which extends outwards from the cylindrical inner passage, a first baffle means, said first baffle means depending from said retention sleeve and being substantially parallel to the third portion of said first member, said second member being generally U-shaped and mountable on said first member with the legs of said second member laterally surrounding the third portion of said first member and said retention sleeve, one end of said second member abutting the periphery of said first baffle means, a second baffle means, said second baffle means extending transversely from the base of said second member at the other end of said second member so that an end portion of said second baffle means overlies said first portion of said first member, the portion of said second baffle means between the legs of said second member having a circular opening, and a cylindrical guide sleeve, said guide sleeve extending between and parallel to the legs of said second member from the circular opening in said second baffle means, said guide sleeve being coaxially aligned with the circular opening in said third portion of said first member and said retention sleeve, so that a cylindrical lock having a rectilinear shackle and terminal means for lateral extension is receivable in said guide sleeve, said circular opening in the third portion of said first member, and the cylindrical inner passage in said retention sleeve, with said terminal means being laterally extended into said circular inner slot or recess, each of said first and second baffle means covering one end of said second member against ingress of a tool.

5. The locking device of claim 4 in which the lock is a barrel lock.

6. The locking device of claim 4 in which the retention sleeve is cylindrical and the cylindrical inner passage in the retention sleeve is coaxial with the retention sleeve.

7. The locking device of claim 4 in which the second portion of the first member is stepped into two non-coplanar sections, a first section of the second portion being contiguous with a terminal lip of the lid or cover of the container, said terminal lip overlying the wall of the container, a second section of the second portion being juxtaposed with the wall of the container, the means for securing the second portion of the first member to the wall of the container extending through the second section of the second portion of the first member.

8. The locking device of claim 4 in which the means for securing the second portion of the first member to the wall of the container comprises a plate, a threaded bolt and a nut, said plate, the wall of the container, and the second portion of the first member each having an opening, said openings being coaxial, said plate being disposed inside the container with said bolt extending through said coaxial openings, said nut being screwed onto the end of said threaded bolt.

9. The locking device of claim 8 in which the head of the threaded bolt is inside the container and juxtaposed with the plate.

10. The locking device of claim 8 in which the plate extends to the edge of the container wall so that the end of the plate is contiguous with the lid or cover of the container.

11. The locking device of claim 10 in which the plate is rectangular, with one edge of the plate being parallel to and juxtaposed with the lid or cover of the container.

12. The locking device of claim 4 in which the guide sleeve extends outwards beyond the opening in the second baffle.

13. The locking device of claim 12 in which the outward extension of the guide sleeve is provided with at least two openings, so that a seal may be inserted into the outward extension of the guide sleeve to cover the lock.

14. The locking device of claim 4 in which the terminal edge of each of the legs of the second member is stepped into two non-coaxial sections, a first section of said terminal edge being contiguous with a terminal lip of the lid or cover of the container, a second section of said terminal edge being juxtaposed with the wall of the container.

15. The locking device of claim 4 in which the third portion of the first member is provided with a terminal tab and the base of the second member is provided with a slot, said tab extending into said slot.

16. A tamper-proof locking device mountable on a lidded container or the like comprising a unitary bracket, said bracket including a first member and a second member, said first member being a generally zig-zag strip which is divided into a first, a second and a third portion in series at substantially right angles to each other, means for securing the second portion of said first member to the wall of a container or the like adjacent the interface between the container wall and the lid or cover of the container, so that said first portion of said first member overlies the lid or cover of the closed container when said bracket is emplaced, said third portion of said first member having a circular opening, said second member being generally U-shaped and attached to said first member with the legs of said second member laterally surrounding the third portion of said first member and with the base of a portion of said second member being substantially parallel to at least part of the second portion of said first member, so that an enclosure is formed by the second and third portions of said first member and said portion of said second member, a first baffle means, said first baffle means being attached to and extending across one end of said second member and being spaced from and substantially parallel to the third section of said first member, a second baffle means, said second baffle means extending transversely from the base of said second member at the other end of said second member and terminating at the second portion of said first member, said second baffle means having a circular opening, and a cylindrical guide sleeve, said guide sleeve depending from the circular opening in said second baffle means and extending into said enclosure, said guide sleeve being coaxially aligned with the circular opening in said third portion of said first member, so that a cylindrical lock having a rectilinear shackle and terminal means for lateral extension is receivable in said guide sleeve and in the circular opening in the third portion of said first member, with said terminal means being laterally extended between the third portion of said first member and said first baffle means, each of said first and second baffle means covering one end of said second member against ingress of a tool.

17. The locking device of claim 16 in which the lock is a barrel lock.

18. The locking device of claim 16 in which the second portion of the first member is stepped into two non-coplanar sections, a first section of the second portion being contiguous with a terminal lip of the lid or cover of the container, said terminal lip overlying the wall of the container, a second section of the second portion being juxtaposed with the wall of the container, the means for securing the second portion of the first member to the wall of the container extending through the second section of the second portion of the first member.

19. The locking device of claim 16 in which the means for securing the second portion of the first member to the wall of the container comprises a plate, a threaded bolt and a nut, said plate, the wall of the container, and the second portion of the first member each having an opening, said openings being coaxial, said plate being disposed inside the container with said bolt extending through said coaxial openings, said nut being screwed onto the end of said threaded bolt.

20. The locking device of claim 19 in which the head of the threaded bolt is inside the container and juxtaposed with the plate.

21. The locking device of claim 19 in which the plate extends to the edge of the container wall so that the end of the plate is contiguous with the lid or cover of the container.

22. The locking device of claim 21 in which the plate is rectangular, with one edge of the plate being parallel to and juxtaposed with the lid or cover of the container.

23. The locking device of claim 19 together with a clip, a first portion of said clip being attached to one edge of the plate, a second portion of said clip depending substantially perpendicularly from an edge of said first portion of said clip and being parallel to and spaced from said plate, so that said plate is receivable on the edge of the container wall by disposing the container wall between the plate and said second portion of said clip.

24. The locking device of claim 23 in which the first portion of the clip is provided with a coplanar extension so that said extension underlies the lid or cover of the container.

25. The locking device of claim 23 in which the first portion of the clip is provided with a substantially perpendicular extension so that said extension is parallel to the second portion of the clip and contiguously disposed on the opposite side of the plate.

26. The locking device of claim 16 in which the guide sleeve extends outwards beyond the opening in the second baffle.

27. The locking device of claim 26 in which the outward extension of the guide sleeve is provided with at least two openings, so that a seal may be inserted into the outward extension of the guide sleeve to cover the lock.

28. The locking device of claim 16 in which the terminal edge of each of the legs of the second member is stepped into two non-coaxial sections, a first section of said terminal edge being contiguous with a terminal lip of the lid or cover of the container, a second section of said terminal edge being juxtaposed with the wall of the container.

* * * * *